US010787825B2

(12) United States Patent
Schmitz

(10) Patent No.: US 10,787,825 B2
(45) Date of Patent: Sep. 29, 2020

(54) TROWEL

(71) Applicant: The Boeing Company, Chicago, IL (US)

(72) Inventor: Chad D. Schmitz, Arlington, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/667,754

(22) Filed: Aug. 3, 2017

(65) Prior Publication Data

US 2017/0335577 A1 Nov. 23, 2017

Related U.S. Application Data

(62) Division of application No. 14/071,847, filed on Nov. 5, 2013, now Pat. No. 9,752,333.

(51) Int. Cl.

| | |
|---|---|
| ***E04F 21/16*** | (2006.01) |
| ***E04F 21/02*** | (2006.01) |
| ***E04F 21/06*** | (2006.01) |
| ***B05D 1/28*** | (2006.01) |

(52) U.S. Cl.
CPC ..... *E04F 21/162* (2013.01); *B05D 1/28* (2013.01); *E04F 21/023* (2013.01); *E04F 21/06* (2013.01)

(58) Field of Classification Search
CPC ..... B05C 17/00; E04F 21/161; E04F 21/162; E04F 21/163; E04F 21/06
See application file for complete search history.

(56) References Cited

U.S. PATENT DOCUMENTS

| | | | | |
|---|---|---|---|---|
| 2,824,330 | A | 2/1958 | Williams | |
| 4,121,786 | A | 10/1978 | Hathaway | |
| 7,784,143 | B1 * | 8/2010 | Murray | E04F 21/162 148/588 |
| 2008/0011428 | A1 * | 1/2008 | Turner | B44C 7/04 156/574 |

FOREIGN PATENT DOCUMENTS

| | | | | |
|---|---|---|---|---|
| DE | 1030606 | B | 5/1958 | |
| DE | 3941422 | C1 | 5/1991 | |
| DE | 19639509 | A1 | 1/1998 | |
| DE | 202009001870 | * | 7/2009 | B05C 17/10 |
| DE | 202009001870 | U1 * | 7/2009 | B05C 17/002 |
| DE | 202009001870 | U1 | 8/2009 | |

(Continued)

OTHER PUBLICATIONS

European Patent Office, Communication pursuant to Article 94(3) EPC, EP 14 191 933.2 (Jan. 15, 2018).

(Continued)

*Primary Examiner* — Dah-Wei D. Yuan
*Assistant Examiner* — Nga Leung V Law
(74) *Attorney, Agent, or Firm* — Walters & Wasylyna LLC

(57) ABSTRACT

A method for applying a layer of curable material to a surface including the steps of: applying the curable material to the surface; positioning a trowel relative to the surface so that a plurality of first radial teeth of the trowel, extending from a working edge of the trowel, is in contact with the surface; and with the plurality of first radial teeth in contact with the surface, moving the trowel across the surface to spread the curable material across the surface at a constant thickness.

21 Claims, 12 Drawing Sheets

(56) References Cited

FOREIGN PATENT DOCUMENTS

| | | | |
|---|---|---|---|
| JP | 57-017773 | | 7/1955 |
| JP | 5-18677 | | 3/1993 |
| JP | 7-76925 | | 3/1995 |
| JP | 2004-017009 | | 1/2004 |
| JP | 2007-285041 | | 11/2007 |
| TW | M391568 | U1 | 11/2010 |
| WO | WO 2008015297 | A2 | 2/2008 |
| WO | WO 2008/015297 | A2 | 7/2008 |

OTHER PUBLICATIONS

Japanese Patent Office, "Notice of Reasons for Rejection," with English translation, App. No. 2014-171274 (dated Jul. 30, 2018).
The State Intellectual Property Office of China, "2nd Notification of Office Action," with English translation, App. No. 201410616767.7 (dated Jul. 6, 2018).
Taiwan Patent Office, Official Letter, 103132196 (Feb. 21, 2018).
Taiwan Patent Office, Official Letter-Translation, 103132196 (Feb. 21, 2018).
The State Intellectual Property Office of China, First Notification of Office Action, 201410616767.7 (dated Feb. 9, 2018).
The State Intellectual Property Office of China, First Notification of Office Action-Translation, 201410616767.7 (dated Feb. 9, 2018).
Taiwan Intellectual Property Office, Examination Report, with English translation, App. No. 107131901 (dated Aug. 23, 2019).

* cited by examiner

TROWEL

PRIORITY

This application is a divisional of U.S. Ser. No. 14/071,847 filed on Nov. 5, 2013.

FIELD

The present disclosure is generally related to trowels and, more particularly, to a trowel for the application of a curable material, such as an adhesive or mortar, to a surface.

BACKGROUND

Adhesive bonding is a common way of fabricating various kinds of components, such as aircraft components. When bonding parts of a component together, a specific amount of adhesive is used to ensure proper bonding of the component. The specific amount of adhesive is typically quantified as the thickness of the layer of adhesive.

However, adhesive application between bonded surfaces of a component can be an inexact process. The process typically includes dispensing an approximate amount of the adhesive to the bonded surface. The adhesive is then spread and leveled on the bonded surface to form an intermediate layer of adhesive having a required and/or desired thickness. A straight edge (e.g., a flat-edged trowel) or a notched trowel (e.g., a plurality of square or triangular teeth disposed on a working edge) may be used to spread and level the adhesive on the bonded surface.

Unfortunately, use of a straight edge to level the adhesive may provide an inexact and/or inconsistent thickness of the intermediate layer. Further, use of a notched trowel may be sensitive to the angle of the notched trowel with respect to the bonded surface to which the adhesive is applied (e.g., as the angle of the notched trowel with respect to the bonded surface changes, the thickness of the intermediate layer of adhesive may also change). For example, using a conventional notched trowel disposed at a 90° angle with respect to the surface to which the adhesive is applied may yield an intermediate layer having a first thickness. Using the same notched trowel disposed at a 45° angle with respect to the surface to which the adhesive is applied may yield a second thickness. The second thickness may be considerably less than the first thickness (e.g., approximately 70% of the first thickness). Given the human element of the spreading and leveling process, the overall thickness of the intermediate layer of adhesive may vary across the bonded surface.

Thus, the use of a straight edge or a notched trowel may lead to too little adhesive or too much adhesive being applied to the bonded surface. Too little adhesive may lead to an insufficient bond between bonded surfaces of the component. Too much adhesive may squeeze out from between bonded surfaces of the component and/or may form a bond line that is too thick. To avoid applying too little adhesive, operators may use too much adhesive and remove (e.g., clean up) any excess adhesive that may squeeze out. This excess adhesive removal process may take longer than the application process and requires that excess adhesive be properly disposed of due to hazardous chemicals in the adhesive compound. To avoid having to clean up excess adhesive, operators may use too little adhesive, which may cause improper bonding and possible failure of the component.

Accordingly, those skilled in the art continue with research and development efforts in the field of application of a curable material to a surface.

SUMMARY

In one embodiment, the disclosed trowel may include at least one working edge, and a plurality of radial teeth extending from the working edge.

In another embodiment, the disclosed trowel may include a main body including at least one working edge, the working edge including an edge radius, a plurality of radial teeth extending from the working edge, each radial tooth of the plurality of radial teeth including a radial edge and a tooth radius, and wherein a distance between the edge radius and the tooth radius at any point along the working edge is the same.

In another embodiment, also disclosed is a method for uniformly applying an intermediate layer of curable material to a surface, the method may include the steps of: (1) applying an initial amount of the curable material to a surface; (2) moving the trowel across the surface to spread and level the initial amount of curable material; wherein, during the moving step, the trowel is positioned at a non-zero angle relative to the surface; and wherein the trowel spreads and levels the initial amount of curable material to a constant thickness, the constant thickness being independent of the non-zero angle.

In yet another embodiment, also disclosed is a method for applying a layer of curable material to a surface, the method may include the steps of: (1) applying the curable material to the surface; (2) positioning a trowel relative to the surface so that a plurality of first radial teeth of the trowel, extending from a working edge of the trowel, is in contact with the surface; and (3) with the plurality of first radial teeth in contact with the surface, moving the trowel across the surface to spread the curable material across the surface at a constant thickness.

Other embodiments of the disclosed trowel will become apparent from the following detailed description, the accompanying drawings and the appended claims.

DETAILED DESCRIPTION

Figure 1:
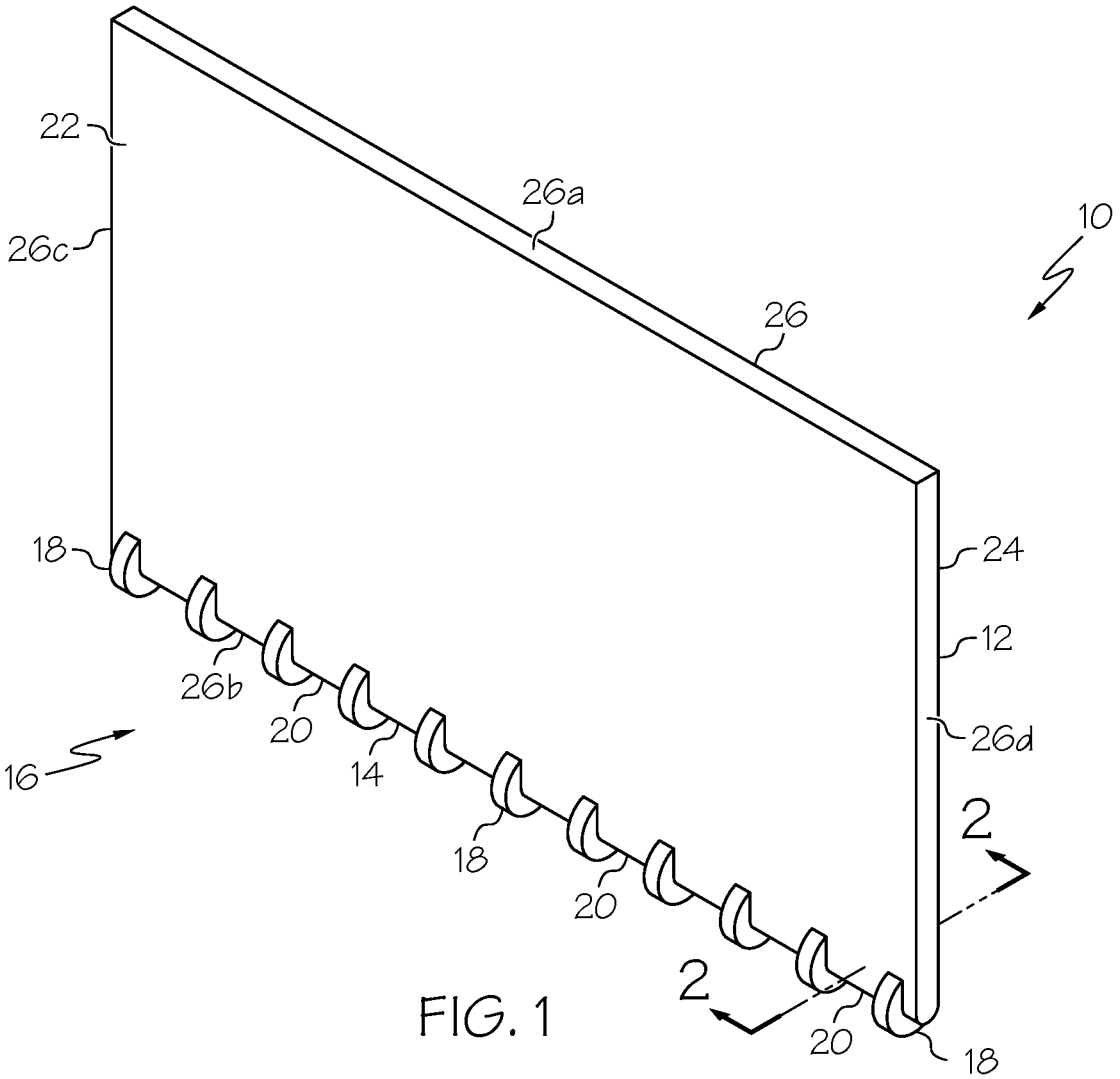
FIG. 1 is a front and side perspective view of one embodiment of the disclosed trowel.

The following detailed description refers to the accompanying drawings, which illustrate specific embodiments of the disclosure. Other embodiments having different structures and operations do not depart from the scope of the present disclosure. Like reference numerals may refer to the same element or component in the different drawings.

Referring to FIG. 1, one embodiment of the disclosed trowel, generally designated 10, may include a main body 12 having at least one working edge 14. A plurality of radial teeth 16 may be connected to, and may be axially aligned along, the working edge 14. Each radial tooth 18 of the plurality of radial teeth 16 may extend radially outward from the working edge 14 of the main body 12 (e.g., having at least one radial edge projected from the working edge 14 of the main body 12). Each radial tooth 18 may be aligned with and spaced apart (e.g., equally spaced or variably spaced) from an adjacent radial tooth 18 to define a gap 20 therebetween. The radial teeth 18 may be solid disks of various configurations or solid spheres. Other shapes of the radial teeth 18 are also contemplated.

In one implementation, the radial teeth 18 may be fixedly connected to the main body 12 such that the radial teeth 18 are stationary. In another, optional implementation, the radial teeth 18 may be rotatably connected to the main body 12 such that the radial teeth 18 rotate about an axis.

The main body 12 may include a first surface 22, a second surface 24 opposite the first surface, and a perimeter edge 26. In an example construction, the first surface 22 and the second surface 24 may be substantially planar and the main body 12 may have a constant thickness. In another example construction, the first surface 22 and the second surface 24 may be contoured, for example having an ergonomic-assisting curvature that provides a comfortable grip, while the radial teeth 18 remain in a linear arrangement. For example, the thickness of the main body 12 at a central region may be greater than the thickness of the main body 12 proximate (e.g., at or near) one or more perimeter edge 26 to provide a more comfortable gripping surface.

Optionally, the main body 12 may include a handle (not shown) connected to at least one of the first surface 22 or the second surface 24.

The main body 12 may have any shape and the perimeter edge 26 may have any geometric profile. In an example construction, as illustrated in FIG. 1, the main body 12 may have a generally rectangular shape and the perimeter edge 26 may include a first (e.g., upper) edge 26*a*, a second (e.g., lower) edge 26*b*, a third (e.g., left side) edge 26*c*, and a fourth (e.g., right side) edge 26*d*. The working edge 14 may be defined by one or more perimeter edges 26 (e.g., the second edge 26*b*) of the main body 12.

In an example construction, the plurality of radial teeth 16 may extend along substantially all of the working edge 14 (e.g., along the second edge 26*b* from proximate the third edge 26*c* to proximate the fourth edge 26*d*). In another example construction, the plurality of radial teeth 16 may extend along a portion of the working edge 14.

In an example construction, as illustrated in FIG. 1, at least one working edge 14 may be substantially straight for use of the trowel 10 to apply a constant thickness, uniform intermediate layer 30 of curable material 32 (e.g., adhesive or mortar, such as thinset) on a substantially planar surface 34. Each radial tooth 18 of the plurality of radial teeth 16 on the straight working edge 14 may extend substantially perpendicular to a respective location of the working edge 14.

In another example construction, at least one working edge 14 may be curved or include a contoured profile (not shown) for use of the trowel 10 to apply a constant thickness, uniform intermediate layer 30 of curable material 32 on a curved or contoured surface (not shown). Each radial tooth 18 of the plurality of radial teeth 16 on the contoured working edge 14 may extend substantially perpendicular to a respective location of the working edge 14.

In another example construction, the main body 12 may include at least one straight working edge 14 and at least one curved or contoured working edge 14 (not shown) to apply a constant thickness, uniform intermediate layer 30 of curable material 32 on a straight surface 34 and a contoured surface (not shown). As will be described in greater detail herein (e.g., FIG. 18), the configuration of the plurality of radial teeth 16 on each working edge 14 may be the same or may be different.

Figure 2:
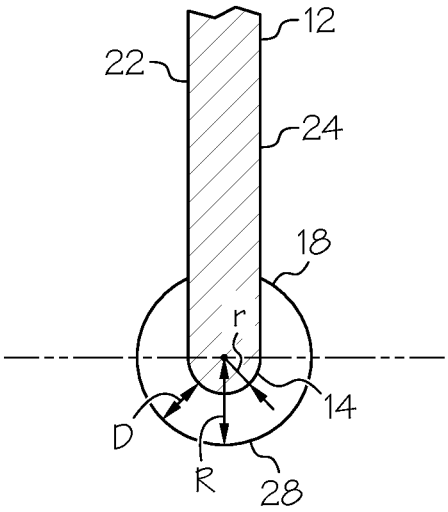
FIG. 2 is a partial side elevational view, in section, of the trowel of FIG. 1.

As shown in FIG. 2, in an example embodiment, each radial tooth 18 may be substantially centered on the working edge 14 of the main body 12. For example, the center of the working edge 14 may be aligned with the center of the radial tooth 18 such that the working edge 14 may be maintained at a constant spaced apart distance relative to a surface 34 (FIG. 4) of a part irrespective of the angle of the trowel 10 with respect to the surface 34. In an example construction, the working edge 14 may include a substantially semi-circular cross-sectional shape having an edge radius r relative to the center of the working edge 14. Each radial tooth 18 of the plurality of radial teeth 16 (FIG. 1) may include a substantially circular cross-sectional shape having a tooth radius R relative to the center of the radial tooth 18. Thus, a straight-line distance D between the working edge 14 and a radial edge 28 of the radial tooth 18 (e.g., the tooth radius R minus the edge radius r) at any point along the working edge 12 may be substantially equal.

Figure 3:
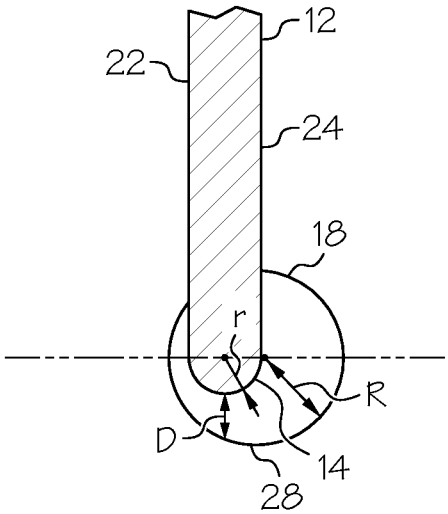
FIG. 3 is a partial side elevational view, in section, of another embodiment of the disclosed trowel.

As shown in FIG. 3, in another example embodiment, each radial tooth 18 may be at least partially offset from the working edge 14 of the main body. For example, the center of the radial tooth 18 may be offset from the center of the working edge 14 such that the spaced apart distance between the working edge 14 relative to the surface 34 (FIG. 4) of a part may vary depending upon the angle of the trowel 10 with respect to the surface 34.

As shown in FIGS. 4-7, the disclosed trowel 10 may be used for the application of an intermediate layer 30 of curable material 32 (e.g., an adhesive) to the surface 34 of a part, such as a bonded surface of a bonded component. As also shown in FIGS. 4-7, the disclosed trowel 10 may also be used for spreading and/or thinning the curable material on the surface 34 of the part. The intermediate layer 30 of curable material 32 may, for example, be an adhesive layer, a waterproof layer, and/or a vapor barrier layer. After application of the intermediate layer 30 of curable material 32, a surface of another part may be applied and bonded to the intermediate layer 30 of curable material 32 to form the bonded component.

Figure 4:
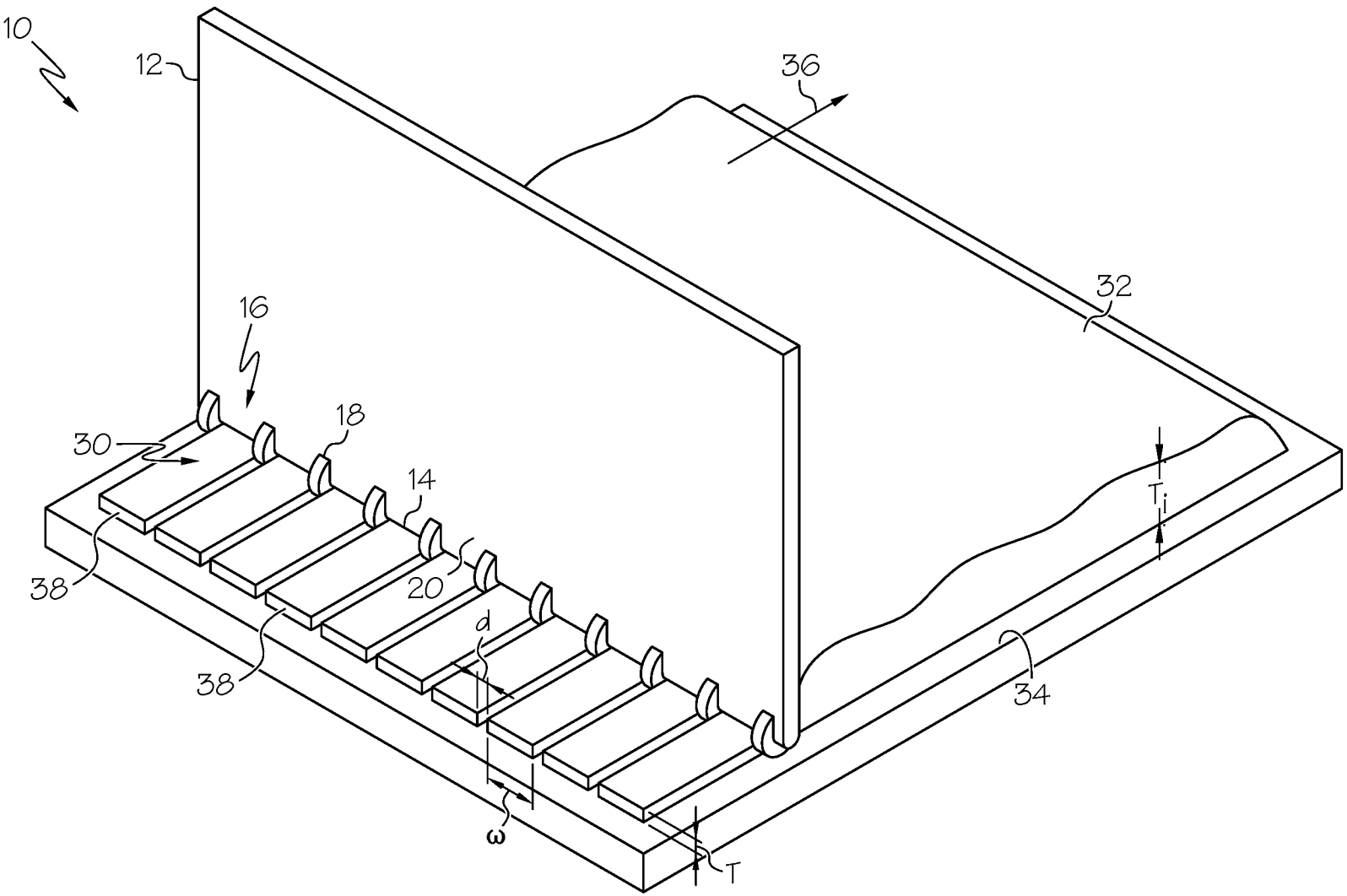
FIG. 4 is a front and side perspective view of one implementation of the disclosed trowel depicted at a first angle with respect to a surface to which a curable material is applied.

In an example implementation, the curable material 32 (e.g., an adhesive) may be applied to the surface 34 at an initial thickness $T_i$ (e.g., an applied thickness). As illustrated in FIG. 4, the disclosed trowel 10 may be moved across the surface 34, such as in the direction indicated by directional arrow 36, to spread and level the curable material 32 and form the intermediate layer 30. The trowel 10 may be configured to maintain a constant thickness t of the intermediate layer 30 (e.g., as the curable material 32 is spread over the surface 34) irrespective of the angle of the trowel 10 with respect to the surface 34 to which the curable material 32 is applied.

Figure 5:
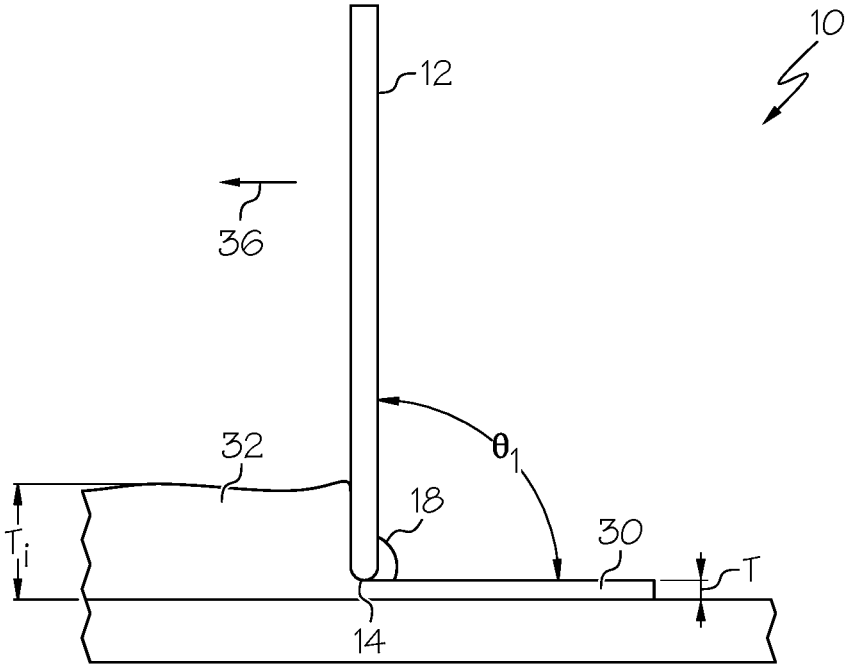
FIG. 5 is a side elevational view of the trowel of FIG. 4.
Figure 6:
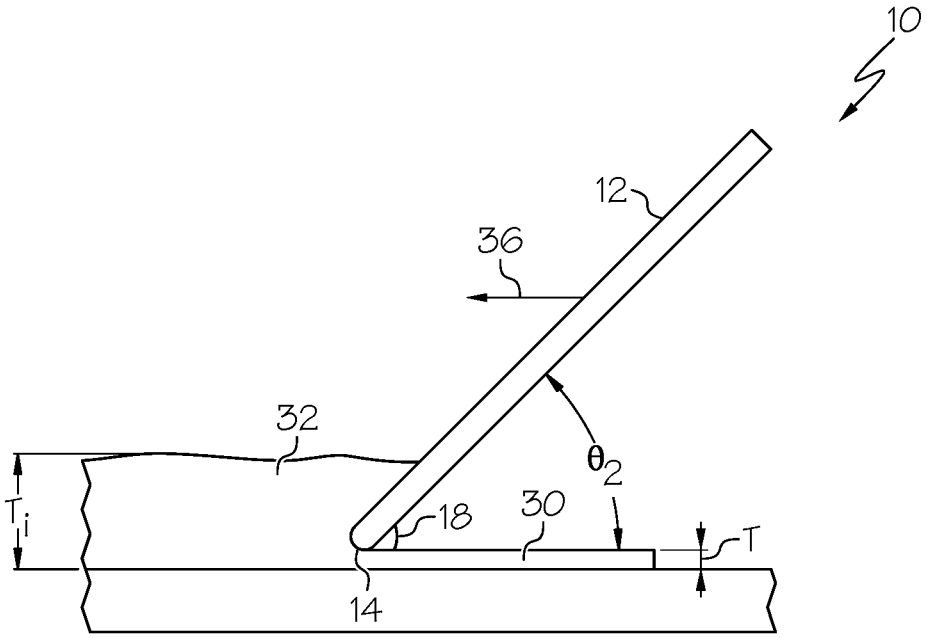
FIG. 6 is a side elevational view of another implementation of the disclosed trowel depicted at a second angle with respect to the surface to which a curable material is applied.
Figure 7:
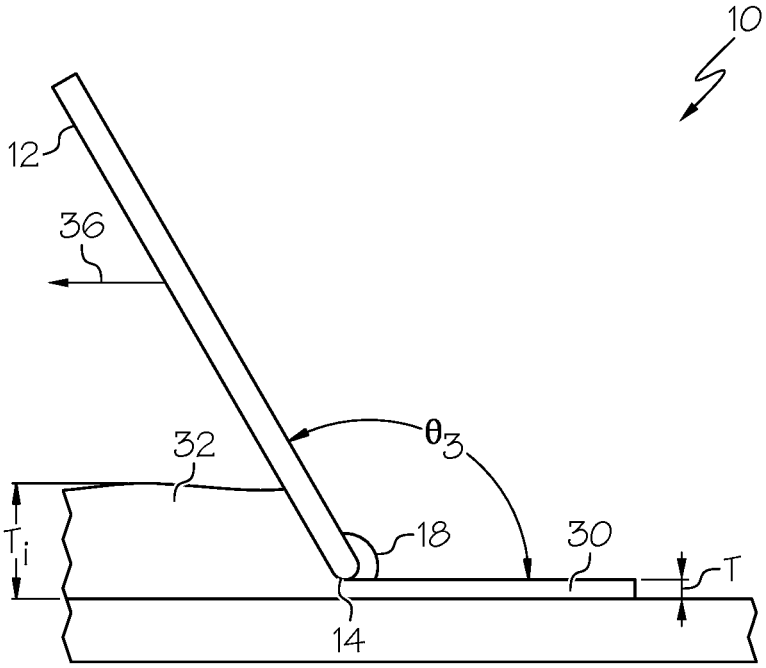
FIG. 7 is a side elevational view of another implementation of the disclosed trowel depicted at a third angle with respect to the surface to which a curable material is applied.

The trowel 10 may be pushed along the surface 34 (e.g., FIG. 6) or dragged across the surface 34 (e.g., FIG. 7) at relatively any non-zero angle with respect to the surface 34 to spread and level the curable material 32. For example, as illustrated in FIG. 5, the trowel 10 may be positioned at a first angle $\theta_1$ (e.g., approximately 90°) with respect to the surface 34. As the trowel 10 is moved across the surface 34 (e.g., in the direction of arrow 36), the intermediate layer 30 may have the constant thickness T. As another example, as illustrated in FIG. 6, the trowel 10 may be positioned at a second angle $\theta_2$ (e.g., approximately 45°) with respect to the surface 34. As the trowel 10 is pushed across the surface 34 (e.g., in the direction of arrow 36), the intermediate layer 30 may have the constant thickness T. As yet another example, as illustrated in FIG. 7, the trowel 10 may be positioned at a third angle $\theta_3$ (e.g., approximately 120°) with respect to the surface 34. As the trowel 10 is drug across the surface 34 (e.g., in the direction of arrow 36), the intermediate layer 30 may have the constant thickness T.

Thus, the position (e.g., angle) of the trowel 10 with respect to the surface 34 may change or vary throughout the movement of the trowel 10 across the surface 34 without affecting the thickness t of the intermediate layer 32.

As will be described in more detail herein below, each radial tooth 18 of the plurality of radial teeth 16 may include at least one radial edge. For example, the radial edge may extend circumferentially. As another example, the radial edge may include a constant curve. As yet another example, the radial edge may include at least two flat segments that intersect.

Referring to FIGS. 8-15, each radial tooth 18 of the plurality of radial teeth 16 (FIG. 1) may include a generally disk-shaped tooth body 40 having a circular cross-sectional shape (e.g., having a circumferential radial edge 28) and the tooth radius R. The tooth body 30 may include a first side 44, a second side 46 opposite the first side 44, and a substantially circular radial edge 28. The tooth body 40 may include a thickness $t_1$. The radial edge 28 may include a thickness $t_2$. At least a portion of a peripheral surface 42 of the tooth body 40 (e.g., the radial edge 28) may contact the surface 34 as the trowel 10 is moved across the surface 34 to spread and level the curable material 32 (FIG. 4).

Figure 8:
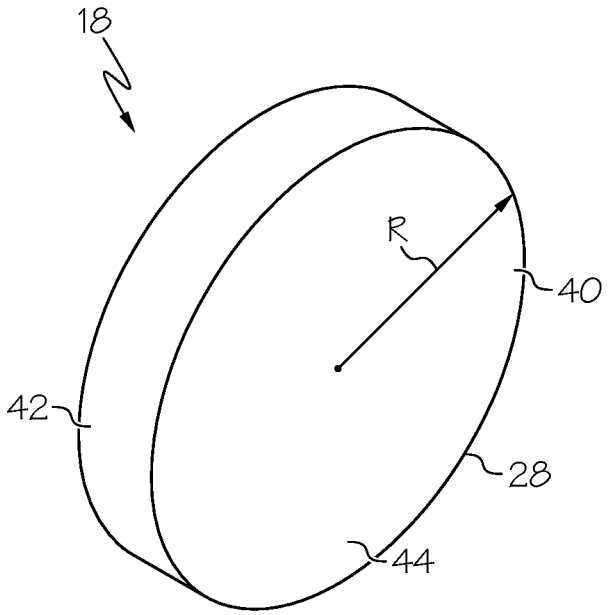
FIG. 8 is front and side perspective view of one embodiment of a radial tooth of the trowel of FIG. 1.
Figure 9:
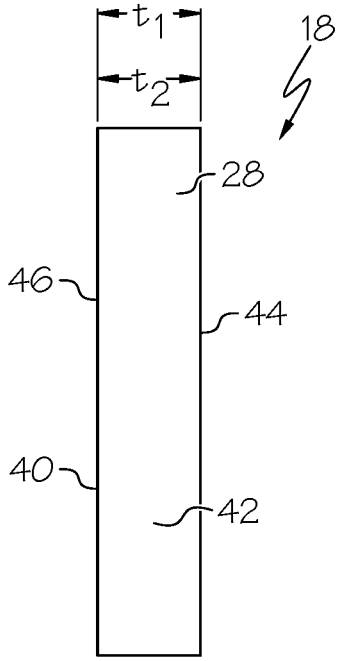
FIG. 9 is a front elevational view of the radial tooth of FIG. 8.

As illustrated in FIGS. 8 and 9, an example embodiment of the radial tooth 18 may include substantially planar first 44 and second 46 sides. The radial edge 28 may be substantially flat from the first side 44 to the second side 46 (e.g., the peripheral surface 42 may be perpendicular to the first 44 and second sides 46) such that the thickness $t_2$ of the radial edge 28 (e.g., the portion of the circumferential surface 42 in contact with the surface 34) is substantially equal to the thickness $t_1$ of the tooth body 40.

Figure 10:
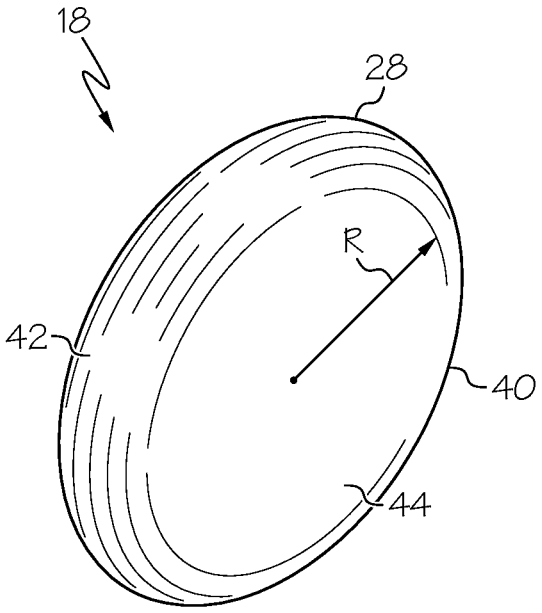
FIG. 10 is front and side perspective view of another embodiment of a radial tooth of the trowel of FIG. 1.
Figure 11:
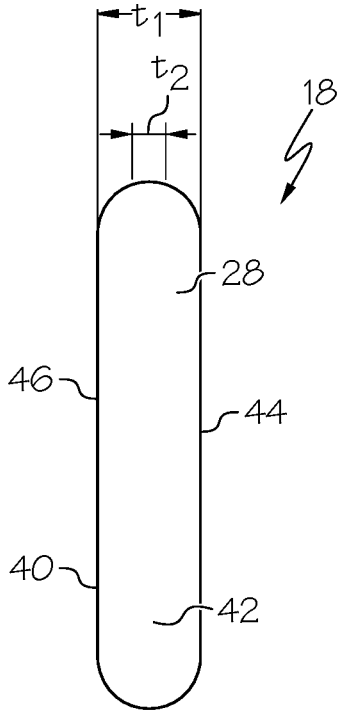
FIG. 11 is a front elevational view of the radial tooth of FIG. 10.

As illustrated in FIGS. 10 and 11, another example embodiment of the radial tooth 18 may include substantially planar first 44 and second 46 sides. The peripheral surface 42 may be rounded outwardly from the first side 44 to the second side 46 such that the thickness $t_2$ of the radial edge 28 (e.g., the portion of the peripheral surface 42 in contact with the surface 34) is less than the thickness $t_1$ of the tooth body 40.

Figure 12:
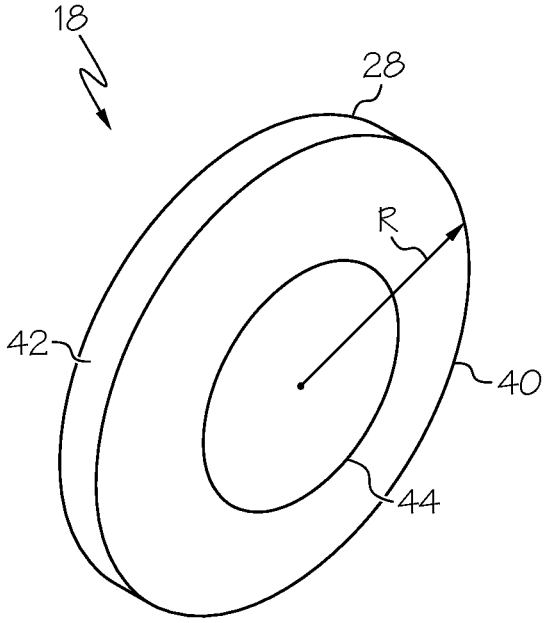
FIG. 12 is front and side perspective view of another embodiment of a radial tooth of the trowel of FIG. 1.
Figure 13:
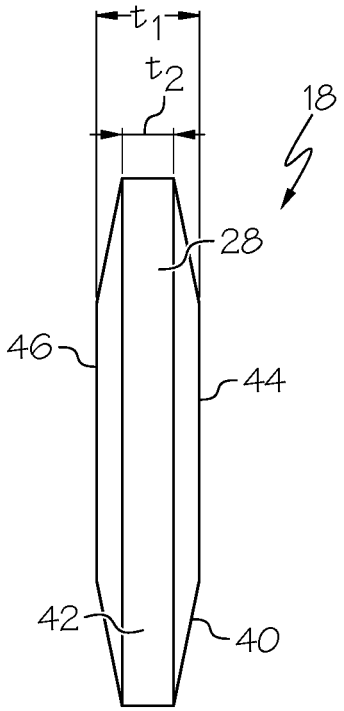
FIG. 13 is a front elevational view of the radial tooth of FIG. 12.

As illustrated in FIGS. 12 and 13, another example embodiment of the radial tooth 18 may include inwardly tapered first 44 and second 46 sides (e.g., the first 44 and second 46 sides may be disposed at an inwardly disposed angle from proximate the center of the tooth body 40 to proximate the radial edge 28). The radial edge 42 may be substantially flat from the first side 44 to the second side 46 (e.g., the peripheral surface 42 may be perpendicular to the first 44 and second sides 46) such that the thickness $t_2$ of the radial edge 28 (e.g., the portion of the peripheral surface 42 in contact with the surface 34) is substantially less than the thickness $t_1$ of the tooth body 40.

Figure 14:
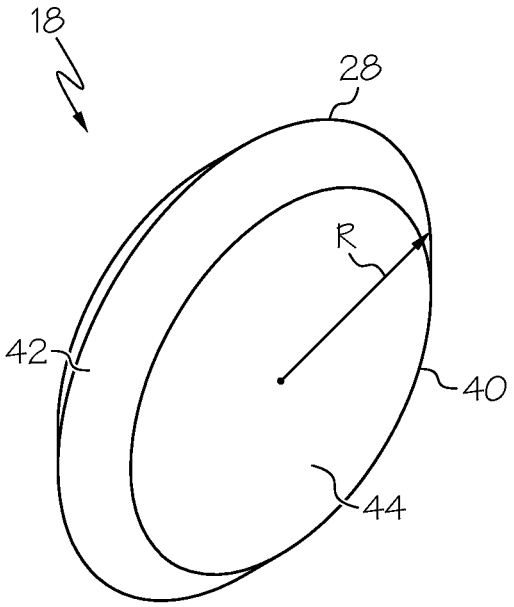
FIG. 14 is a front and side perspective view of another embodiment of a radial tooth of the trowel of FIG. 1.
Figure 15:
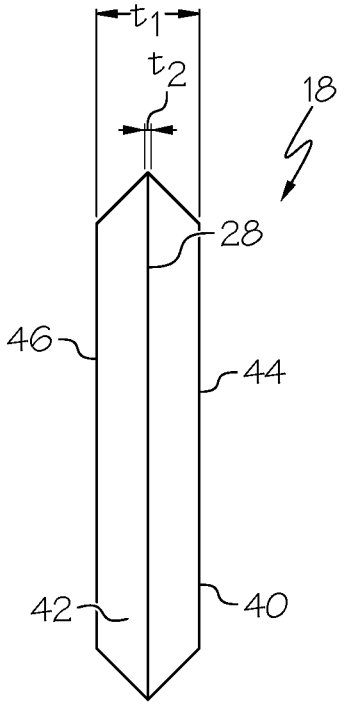
FIG. 15 is a front elevational view of the radial tooth of FIG. 14.

As illustrated in FIGS. 14 and 15, another example embodiment of the radial tooth 18 may include substantially planar first 44 and second 46 sides. The peripheral surface 42 may be disposed at a non-perpendicular angle relative the first 44 and second 46 sides such that the peripheral surface 42 terminates at a point and the thickness $t_2$ of the radial edge 28 (e.g., the portion of the peripheral surface 42 in contact with the surface 34) is substantially less than the thickness $t_1$ of the tooth body 40.

Figure 16:
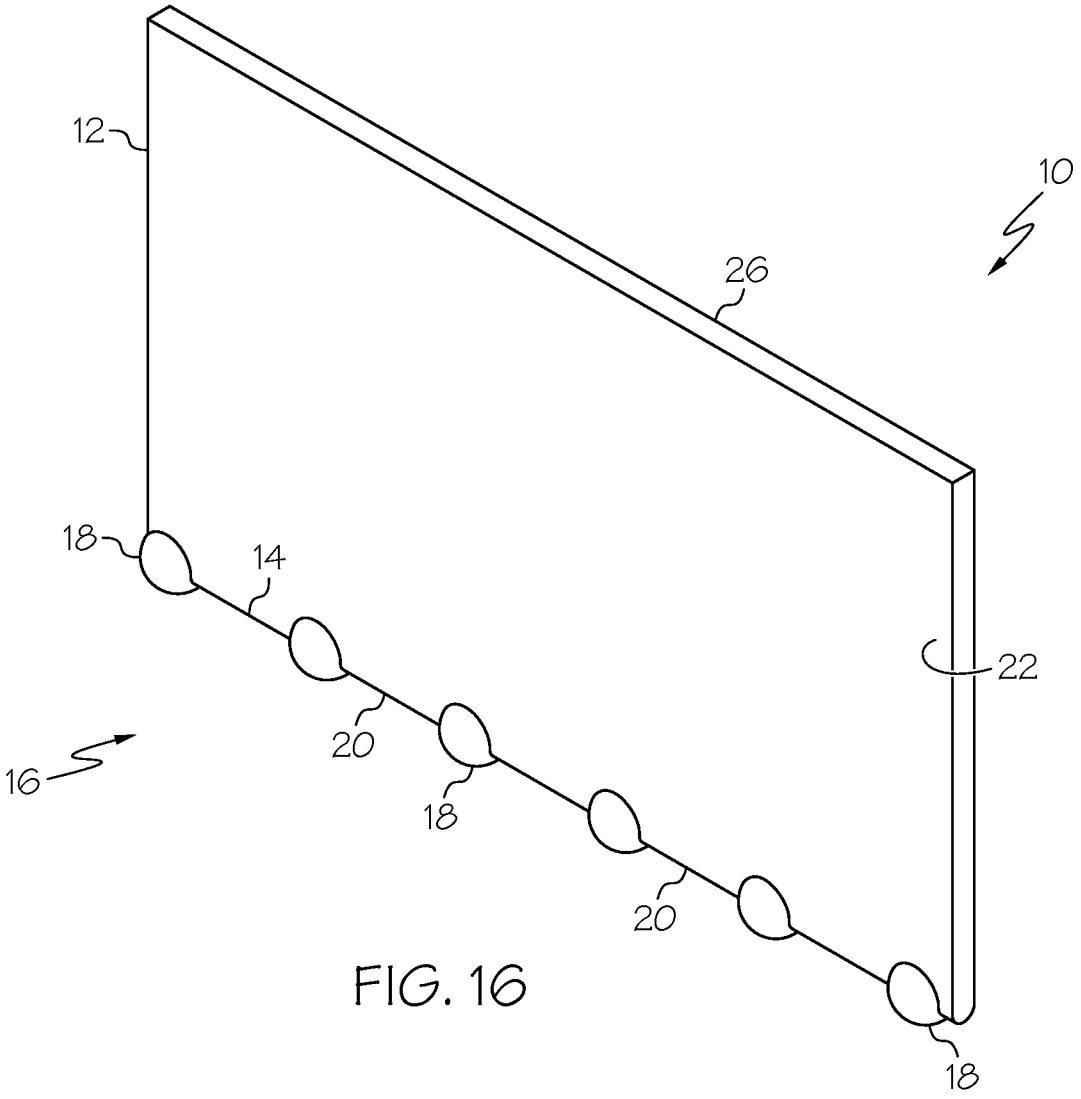
FIG. 16 is a front and side perspective view of another embodiment of the disclosed trowel.
Figure 17:
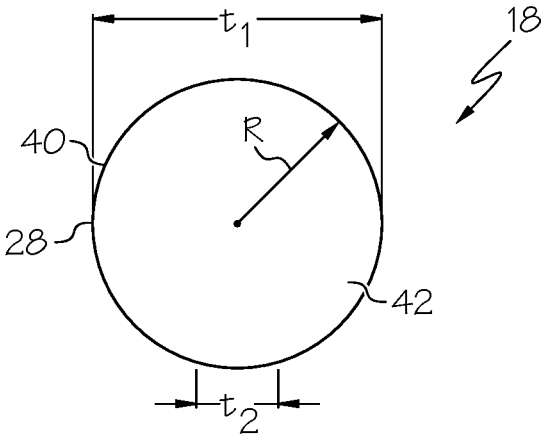
FIG. 17 is front elevational view of another embodiment of the radial tooth of the trowel of FIG. 16.

Referring to FIGS. 16 and 17, another embodiment of the disclosed trowel 10 may include the plurality of radial teeth 16 connected to the working edge 14 of the main body 12. Each radial tooth 18 may be aligned with and spaced apart from an adjacent radial tooth 18 to define a gap 20 therebetween. Each radial tooth 18 of the plurality of radial teeth 16 may include a generally spherical tooth body 40 having a circular cross-sectional shape (e.g., having a radial edge extending circumferentially) and the tooth radius R. The tooth body 40 may include a thickness $t_1$ (e.g., a diameter of the tooth body 40). The radial edge 28 of the tooth body 40 may include a thickness $t_2$. At least a portion of a peripheral surface 42 of each tooth body 42 (e.g., the radial edge 28) may contact the surface 34 as the trowel 10 is moved across the surface 34 to spread and level the curable material 32 (FIG. 4).

Figure 18:
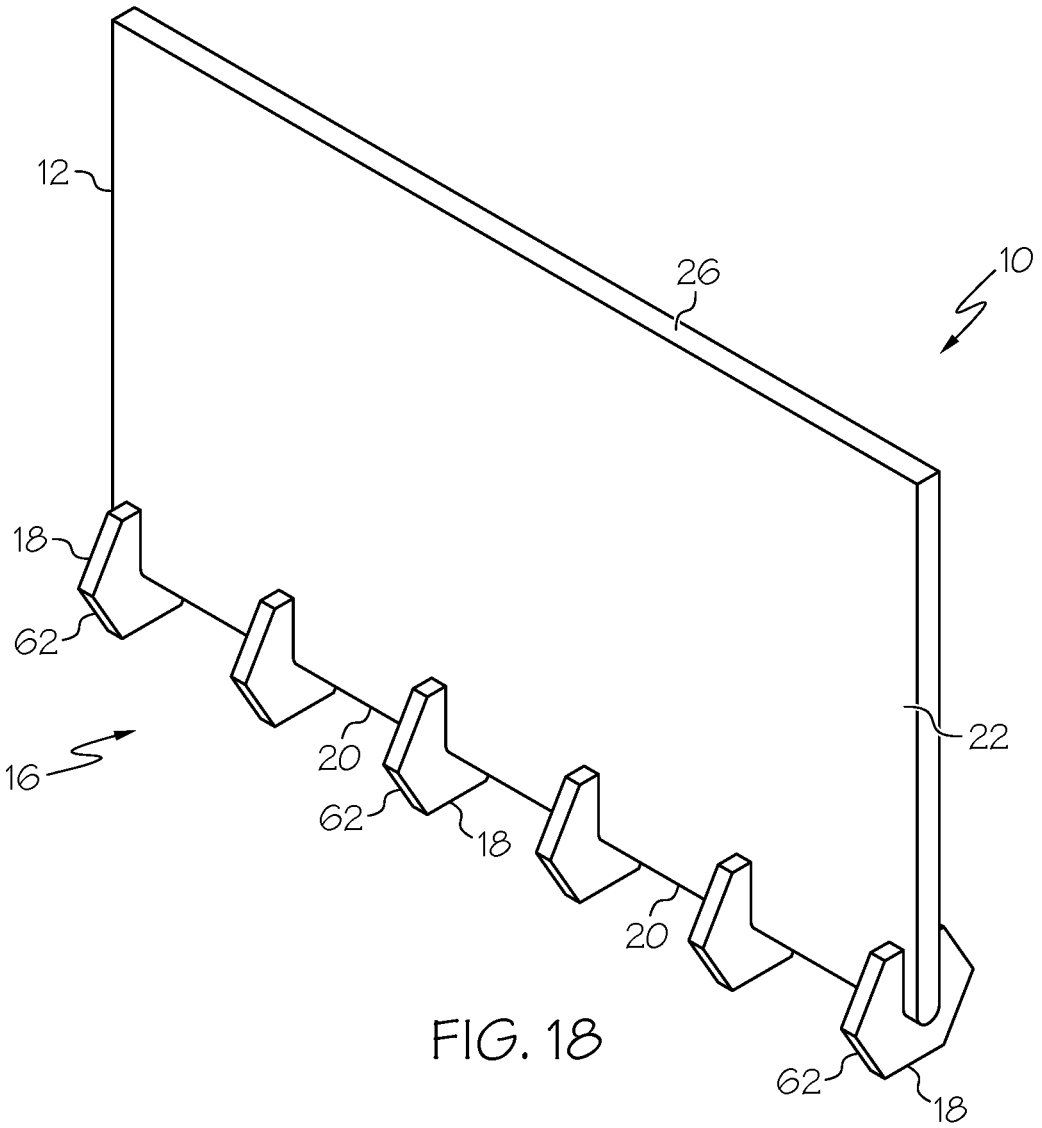
FIG. 18 is a front and side perspective view of another embodiment of the disclosed trowel.
Figure 19:
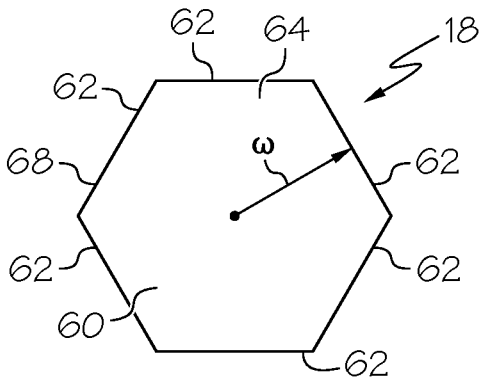
FIG. 19 is a side elevational view of another embodiment of a radial tooth of the trowel of FIG. 18.
Figure 20:
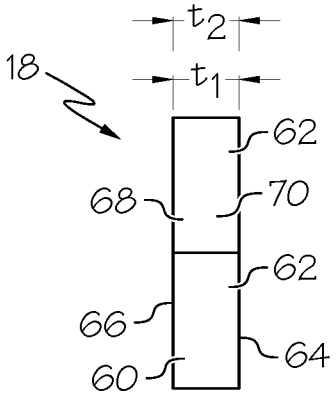
FIG. 20 is front elevational view of the radial tooth of FIG. 19.

Referring to FIGS. 18-20, another embodiment of the disclosed trowel 10 may include the plurality of radial teeth 16 connected to the working edge 14 of the main body 12. Each radial tooth 18 of the plurality of radial teeth 16 may include a tooth body 60 having a generally rectilinear shape (e.g., having a radial edge defined by at least two flat surfaces that intersect). Each radial tooth 18 may be aligned with and spaced apart from an adjacent radial tooth 18 to define a gap 20 therebetween. The tooth body 60 may include a plurality of tooth faces 62 (e.g., sides) defining a peripheral surface 68 of the radial tooth 18. In an example construction, the tooth body 60 may include at least four (4) tooth faces 62. In an example construction, the tooth body 60 may include at least five (5) tooth faces 62. In another example construction, the tooth body may include at least six (6) tooth faces 62. In another example embodiment, the tooth body may include at least eight (8) tooth faces 62. In yet another example embodiment, the tooth body may include more than eight (8) tooth faces.

The tooth body 60 may include a width W defined by the distance from the center of the tooth body 60 to the tooth face 62 (e.g., to the midpoint of the tooth face 62). The tooth body 60 may include a thickness $t_1$ (e.g., a thickness of the tooth body 60). A radial edge 70 of the tooth body 60 may include a thickness $t_2$. At least a portion of the peripheral surface 68 of each tooth body 60 (e.g., the radial edge 70 of at least one tooth face 62) may contact the surface 34 as the trowel 10 is moved across the surface 34 to spread and level the curable material 32 (FIG. 4). The tooth faces 62 (e.g., sections of the substantially flat peripheral surface 68) may be arranged such that the trowel 10 may be positioned at a particular non-zero angle with respect to the surface 34 when a particular tooth face 62 is in contact with (e.g., flat against) the application surface 34. In an example construction, the main body 12 and the working edge 14 may be configured such that the distance from the working edge 14 to any one particular tooth face 62 (e.g., to the midpoint of the tooth face 62) defines a thickness T of the curable material 32 as the curable material 32 is spread and leveled (FIG. 4).

The tooth body 60 may include substantially planar first 64 and second 66 sides. In an example construction, each tooth face 62 may be substantially flat from the first side 64 to the second side 66 (e.g., the peripheral surface 68 may be substantially perpendicular to the first 64 and second sides 66) such that the thickness $t_2$ of the radial edge 70 (e.g., the portion of the tooth face 62 in contact with the surface 34) is substantially equal to the thickness $t_1$ of the tooth body 60.

In another example construction, each tooth face 62 may be disposed at a non-perpendicular angle relative the first 64 and second 66 sides such that the peripheral surface 68 terminates at a point (not shown) and the thickness $t_2$ of the radial edge 70 (e.g., the portion of the tooth face 62 in contact with the surface 34) is substantially less than the thickness $t_1$ of the tooth body 60.

Figure 21:
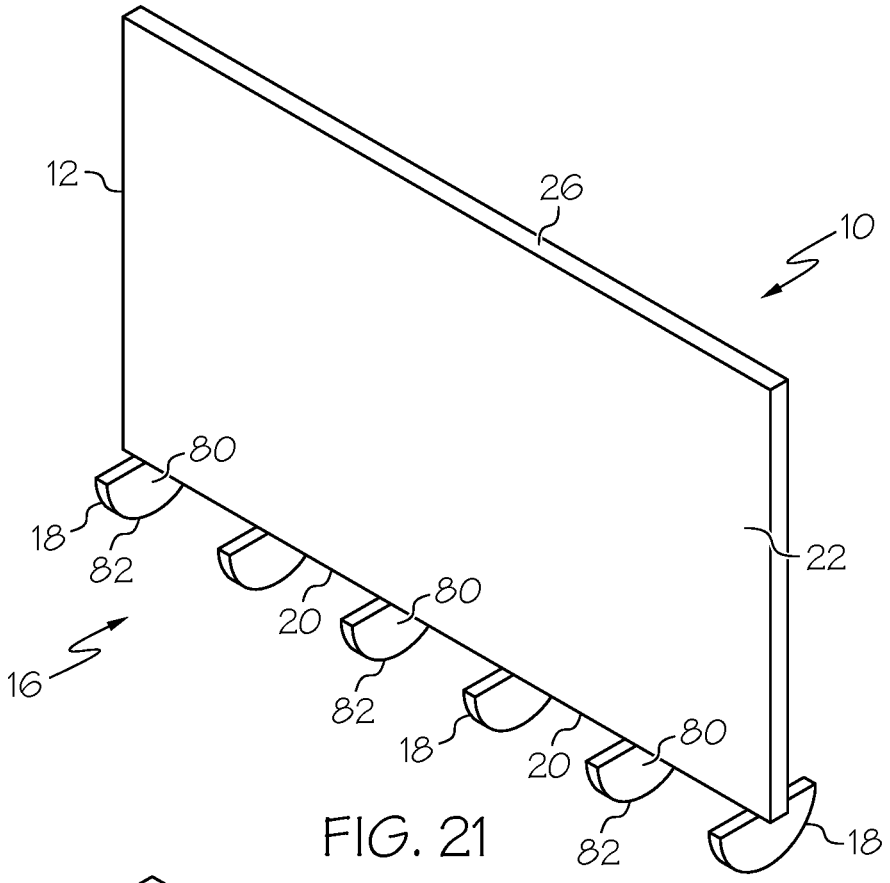
FIG. 21 is a front and side perspective view of another embodiment of the disclosed trowel.

Referring to FIG. 21, another embodiment of the disclosed trowel 10 may include the plurality of radial teeth 16 connected to the working edge 14 of the main body 12. Each radial tooth 18 of the plurality of radial teeth 16 may include a generally semi-circular tooth body 80 (e.g., having a radial defined by a constant curve). Each radial tooth 18 may be aligned with and spaced apart from an adjacent radial tooth 18 to define a gap 20 therebetween. The tooth body 80 may include a first side, a second side opposite the first side, a semi-circular peripheral surface, and a radial edge 82. For example, the radial edge 82 may extend approximately 180 degrees (e.g., a half circle). As another example, the radial edge 82 may extend approximately 270 degrees (e.g., a three-quarters circle).

Each tooth body 80 may include a tooth radius (e.g., from the center of the tooth body 80 to the radial edge 82), a tooth body thickness, and a radial edge thickness (e.g., a portion of a peripheral surface that may contact the surface 34), as described above. Further, each tooth body 80 may include various configurations, as described above and illustrated in FIGS. 8-15.

Figure 22:
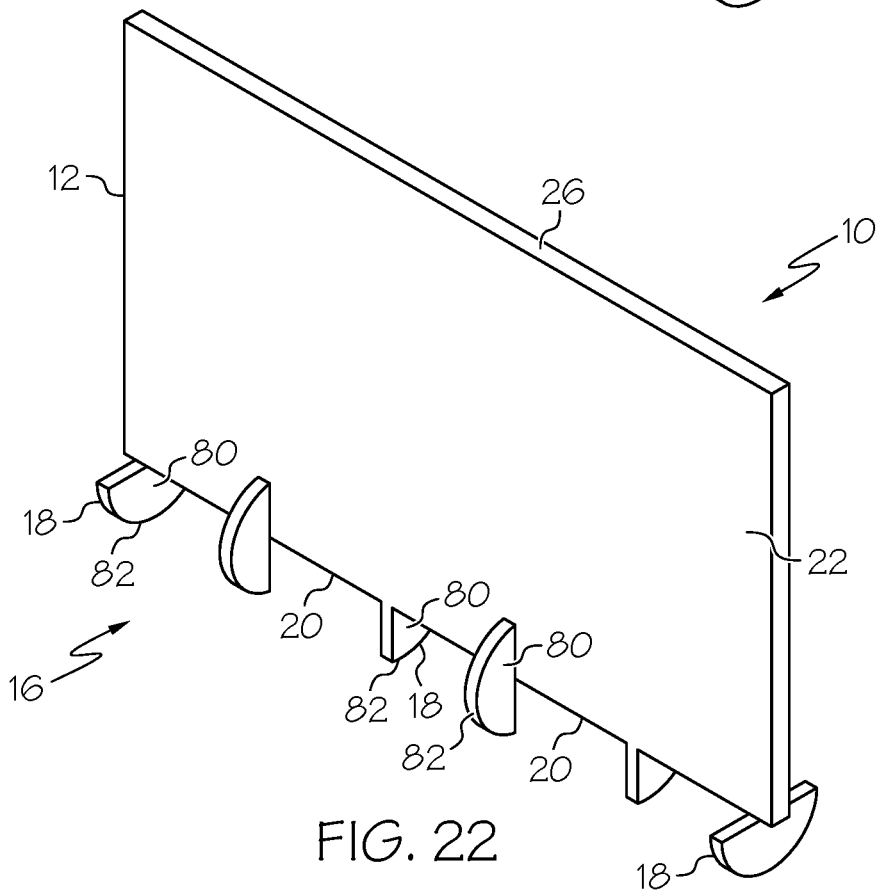
FIG. 22 is a front and side perspective view of another embodiment of the disclosed trowel.

Referring to FIG. 22, in another example embodiment, every other semi-circular radial tooth 18 may be rotated (e.g., by 90 degrees) with respect to an adjacent radial tooth 18 such that at least a portion of a circumferential surface (e.g., the radial edge 82) of at least one tooth body 80 may contact the surface 34 as the trowel 10 is moved across the surface 34 to spread and level the curable material 32 (FIG. 4). Thus, the position (e.g., angle) of the trowel 10 with respect to the surface 34 may change or vary throughout the movement of the trowel 10 across the surface 34 without affecting the thickness t of the intermediate layer 32 (FIG. 4).

Other shapes and configurations of the radial teeth 18 are also contemplated.

Figure 23:
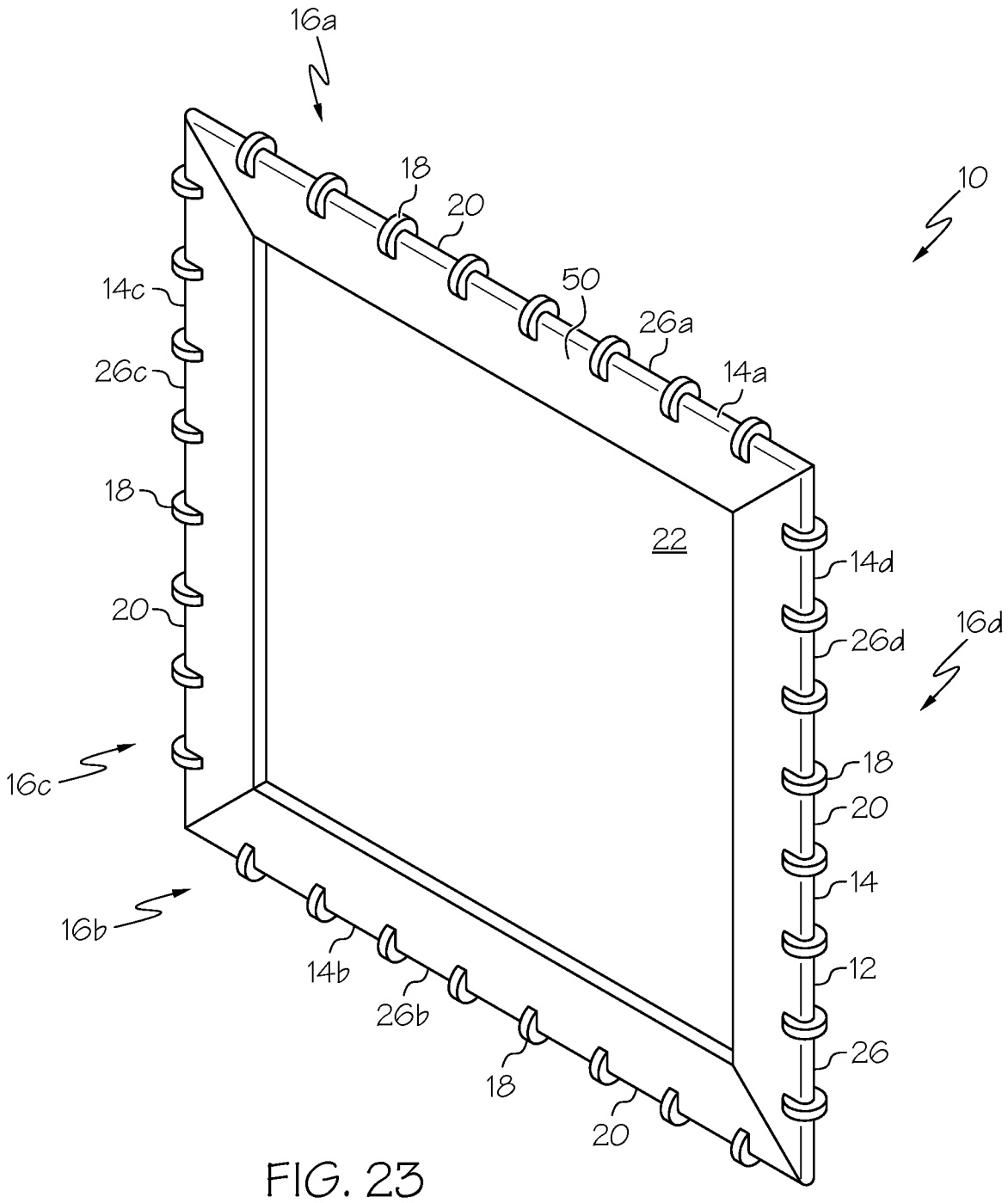
FIG. 23 is a front and side perspective view of another embodiment of disclosed trowel.

Referring to FIG. 23, another embodiment of the disclosed trowel 10 may include the main body 12 having a plurality of working edges 14. A plurality of radial teeth 16 may be connected to each working edge 14 of the plurality of working edges 14. In an example construction, the main body 12 may have a generally rectangular shape and the perimeter edge 26 may include a first (e.g., upper) edge **26*a*, a second (e.g., lower) edge 26*b*, a third (e.g., left side) edge 26*c*, and a fourth (e.g., right side) edge 26*d*. A first working edge 14*a* may be defined by the first edge 26*a*, a second working edge 14*b* may be defined by the second edge 26*b*, a third working edge 14*c* may be defined by the third edge 26*c*, and a fourth working edge 14*d* may be defined by the fourth edge 26*d*. A first plurality of radial teeth 16*a* may extend along substantially the entire first working edge 14*a* (e.g., along the first edge 26*a* from proximate the third edge 26*c* to proximate the fourth edge 26*d*). A second plurality of radial teeth 16*b* may extend along substantially the entire second working edge 14*b* (e.g., along the second edge 26*b* from proximate the third edge 26*c* to proximate the fourth edge 26*d*). A third plurality of radial teeth 16*c* may extend along substantially the entire third working edge 14*c* (e.g., along the third edge 26*c* from proximate the first edge 26*a* to proximate the second edge 26*b*). A fourth plurality of radial teeth 16*d* may extend along substantially the entire fourth working edge 14*d* (e.g., along the fourth edge 26*d* from proximate the first edge 26*a* to proximate the second edge 26*b***).

The configuration of each plurality of radial teeth **16*a*, 16*b*, 16*c*, 16*d* on each working edge 14*a*, 14*b*, 14*c*, 14*d* may be different depending upon the application requirements of a specific curable material 32 and/or the constraints of the surface 34. For example, each plurality of radial teeth 16*a*, 16*b*, 16*c*, 16*d* may include different size, shape, and/or configuration of tooth body 40, 60, 80. As another example, each plurality of radial teeth 16*a*, 16*b*, 16*c*, 16*d* may include a different tooth radius R (FIG. 2). As another example, each plurality of radial teeth 16*a*, 16*b*, 16*c*, 16*d* may include a different thickness $t_1$ of the tooth body 40. As another example, the each plurality of radial teeth 16*a*, 16*b*, 16*c*, 16*d* may include a different thickness $t_2$ of the radial edge 28. As yet another example, each radial tooth 18 of each plurality of radial teeth 16*a*, 16*b*, 16*c*, 16*d* may be spaced apart from an adjacent radial tooth 18 at a different distance (e.g., the gap 20 between adjacent radial teeth 18 may be different for each plurality of radial teeth 16*a*, 16*b*, 16*c*, 16*d***).

Referring again to FIG. 4, those skilled in the art will appreciate that various characteristics of the intermediate layer 30 of curable material 32 (e.g., adhesive) may depend upon the configuration of the plurality of radial teeth 16 and the configuration of each radial tooth 18. For example, the thickness T of the intermediate layer 30 may depend upon the distance D between the working edge 14 and a radial edge 28 of the radial tooth 18 (e.g., the tooth radius R minus the edge radius r) (FIG. 2). As another example, the width w of each line (or strip) 38 of curable material 32 may depend upon the size of the gap 20 (e.g., the distance between adjacent radial teeth 18). As another example, the distance d between adjacent lines 38 of curable material 32 may depend upon the thickness $t_1$ of the tooth body 40 and/or the thickness $t_2$ of the radial edge 28 (FIGS. 8, 10, 12, 14, and 17). As yet another example, the shape and/or profile of the lines 38 of curable material 32 may depend upon the shape of the tooth body 40.

The type and/or configuration of the plurality of radial teeth 16 may be selected based on the surface 34 upon which the curable material 32 (e.g., adhesive) is spread (e.g., disk-shaped tooth body 40 on metal surfaces and spherical-shaped tooth body 40 on composite or plastic surfaces). Further the spacing between radial teeth 18 and/or the size and/or shape of the radial teeth 18 may be customized for different characteristics (e.g., thicknesses T) of the intermediate layer 30 of curable material 32, for how much curable material 32 is to be used, and/or the type of components being bonded together.

Thus, during use of the disclosed trowel 10, different working edges 14 having different configurations of the plurality of radial teeth 16 may be used as needed based on a specific job requirement and/or surface constraint. For example, when different thicknesses T of an intermediate layer 30 of curable material 32 (e.g., adhesive) are to be applied to one or more surfaces 32 by the same operator, the first working edge 14*a* (e.g., including the first plurality of radial teeth 16*a* having a first size and/or shape) may be used on a first surface and the second working edge 14*b* (e.g., including the second plurality of radial teeth 16*b* having a second size and/or shape) may be used on a second surface. This may allow the operator to simply rotate the trowel 10 to apply different characteristics (e.g., thicknesses T) of the intermediate layer 30 without changing trowels.

Optionally, the main body 12 may include a beveled or chamfered edge 50 (FIG. 23) proximate one or more perimeter edge 26. The chamfered edge 50 may be configured to reduce the edge radius r (FIG. 2) and minimize the surface area of the main body 12 that may come into contact with the curable material 32 during leveling of the intermediate layer 30 (FIG. 3).

The disclosed trowel 10 may be fabricated having any configuration of working edges 14 and/or plurality of radial teeth 16 based on the various requirements and/or constraints of the application process. For example, the trowel 10 may be 3D printed, injection molded, or otherwise formed as one piece. Alternatively, the plurality of radial teeth 16 may be coupled to the working edge 14 of the main body 12.

Figure 24:
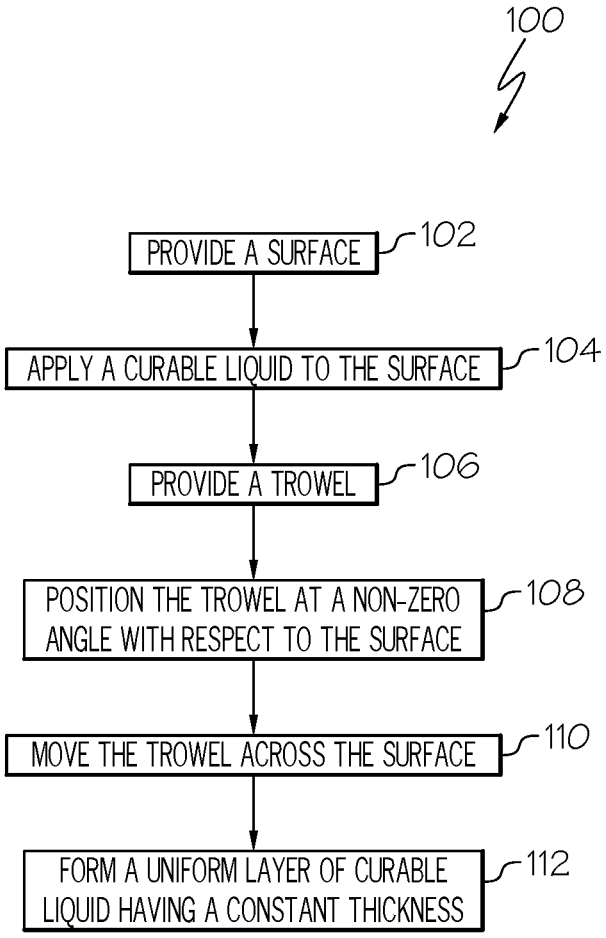
FIG. 24 is a flow chart of one embodiment of the disclosed method for applying a layer of curable material to a surface.

Referring now to FIG. 24, also disclosed is one embodiment of the disclosed method, generally designated 100, for uniformly applying an intermediate layer of curable material to a surface. As shown at block 102, a part may be provided having a surface that will be bonded to a second surface. As shown at block 104, an initial amount of curable material (e.g., adhesive; mortar) may be applied to the surface. The initial amount of curable material may have an initial thickness $T_i$ (FIG. 3). As shown at block 106, a trowel including at least one working edge and a plurality of radial teeth 16 connected to the working edge may be provided. As shown at block 108, the trowel may be positioned at any non-zero angle with respect to the surface. As shown at block 110, the trowel may be moved (e.g., pushed and/or dragged) across the surface to spread and level the initial amount of curable material. As shown at block 112, a uniform intermediate layer of curable material having a constant thickness may be formed.

Figure 25:
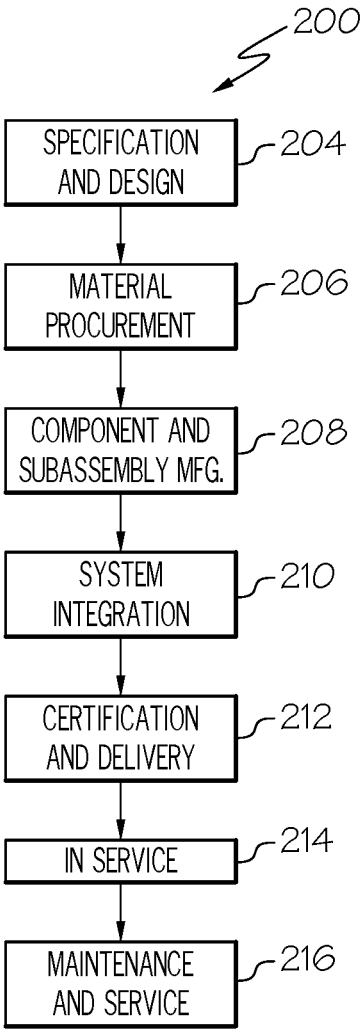
FIG. 25 is flow diagram of an aircraft production and service methodology.

Examples of the disclosure may be described in the context of an aircraft manufacturing and service method 200, as shown in FIG. 25, and an aircraft 202, as shown in FIG. 20. During pre-production, the aircraft manufacturing and service method 200 may include specification and design 204 of the aircraft 202 and material procurement 206. During production, component/subassembly manufacturing 208 and system integration 210 of the aircraft 202 takes place. Thereafter, the aircraft 202 may go through certification and delivery 212 in order to be placed in service 214. While in service by a customer, the aircraft 202 is scheduled for routine maintenance and service 216, which may also include modification, reconfiguration, refurbishment and the like.

Each of the processes of method 200 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

Figure 26:
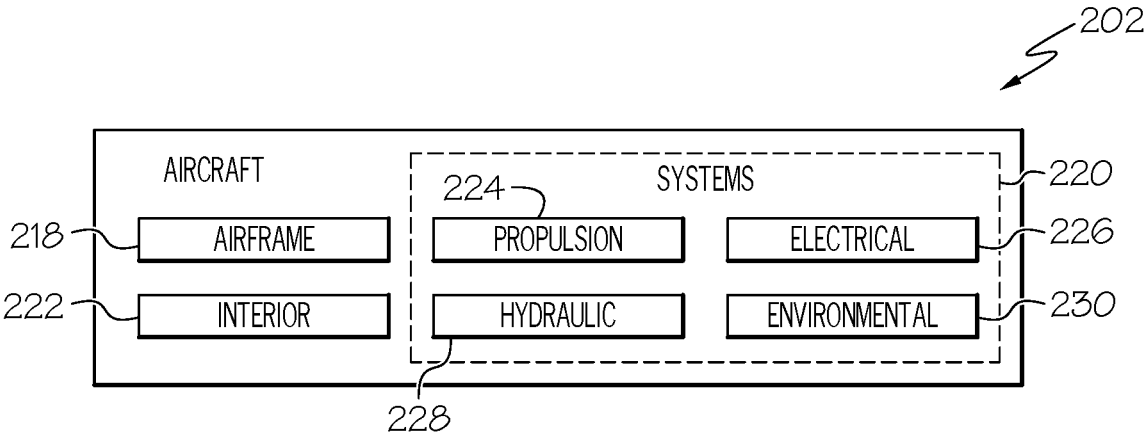
FIG. 26 is a block diagram of an aircraft.

As shown in FIG. 26, the aircraft 202 produced by example method 200 may include an airframe 218 with a plurality of systems 220 and an interior 222. Examples of high-level systems 220 include one or more of a propulsion system 224, an electrical system 226, a hydraulic system 228, and an environmental system 230. Any number of other systems may be included. Although an aerospace example is shown, the principles of the invention may be applied to other industries, such as the automotive industry.

Apparatus and methods embodied herein may be employed during any one or more of the stages of the production and service method 200. As one example, components or subassemblies corresponding to component/subassembly manufacturing 208 may be fabricated or manufactured using the disclosed trowel 10 (FIG. 1). The fabrication during component/subassembly manufacturing 208 may relate to the airframe 218 and/or the interior 222 of the aircraft 202. As another example, system integration 210 may be performed using the disclosed trowel 10. As yet another example, maintenance and service 216 may be performed using the disclosed trowel 10. Use of the disclosed trowel 10 may substantially expedite assembly and/or may reduce the cost of the aircraft 202.

Although various embodiments of the disclosed trowel have been shown and described, modifications may occur to those skilled in the art upon reading the specification. The present application includes such modifications and is limited only by the scope of the claims.

What is claimed is:

1. A method for applying a layer of curable material to a surface using a trowel, comprising a first working edge; a plurality of first radial teeth extending from said first working edge, each one of said first radial teeth comprising a first radial edge and a first straight-line distance extending radially outward from said first working edge to said first radial edge of each one of said first radial teeth that is constant along said first radial edge; a second working edge; and a plurality of second radial teeth extending from said second working edge, each one of said second radial teeth comprising a second radial edge and a second straight-line distance extending radially outward from said second working edge to said second radial edge of each one of said second radial teeth that varies along said second radial edge, said method comprising:

applying an initial amount of said curable material to said surface;

positioning said trowel relative to said surface so that said first radial teeth of said trowel or said second radial teeth of said trowel is in contact with said surface; and spreading said initial amount of said curable material to one of a constant thickness, independent of a non-zero angle of orientation of said trowel relative to said surface, with said first radial teeth in contact with said surface or a variable thickness, dependent on said non-zero angle of orientation of said trowel relative to said surface, with said second radial teeth in contact with said surface.

2. The method of claim 1 wherein said initial amount of said curable material has an initial thickness that is greater than said constant thickness and said variable thickness of said curable material.

3. The method of claim 1 further comprising moving said trowel across said surface when spreading said initial amount of said curable material.

4. The method of claim 3 further comprising dragging said trowel across said surface when moving said trowel across said surface.

5. The method of claim 3 further comprising pushing said trowel across said surface when moving said trowel across said surface.

6. The method of claim 3 further comprising:

with said first radial teeth in contact with said surface, changing said non-zero angle of orientation of said trowel relative to said surface when moving said trowel across said surface; and forming a uniform layer of said curable material having said constant thickness.

7. The method of claim 3 wherein:

each one of said first radial teeth is rotatably coupled to said first working edge; and moving said trowel across said surface comprises rolling said first radial teeth across said surface.

8. A method for using a trowel on a surface, said trowel comprising a first working edge and a second working edge, said method comprising:

spacing said first working edge of said trowel a constant distance from said surface with a plurality of first spacers extending from said first working edge of said trowel, wherein:

each one of said first spacers comprises a first edge-face;

a first straight-line distance extending outward from said first working edge to said first edge-face is constant along said first edge-face; and said constant distance between said first working edge and said surface is independent of a non-zero angle of orientation of said trowel relative to said surface; or spacing said second working edge of said trowel a variable distance from said surface with a plurality of second spacers extending from said second working edge of said trowel, wherein:

each one of said second spacers comprises a second edge-face;

a second straight-line distance extending outward from said second working edge to said second edge-face varies along said second edge-face; and said variable distance between said second working edge and said surface is dependent on said non-zero angle of orientation of said trowel relative to said surface; and with said first spacers or said second spacers in contact with said surface, moving said trowel across said surface.

9. The method of claim 3 further comprising:

with said second radial teeth in contact with said surface, changing said non-zero angle of orientation of said trowel relative to said surface when moving said trowel across said surface; and forming a variable layer of said curable material having said variable thickness.

10. The method of claim 3 wherein:

each one of said second radial teeth is rotatably coupled to said second working edge; and moving said trowel across said surface comprises rolling said second radial teeth across said surface.

11. The method of claim 3 further comprising forming a plurality of parallel lines of said curable material when moving said trowel across said surface.

12. The method of claim 11 wherein:

with said first radial teeth in contact with said surface, a distance between adjacent ones of said parallel lines is dependent upon a first tooth thickness of said first radial teeth; and with said second radial teeth in contact with said surface, said distance between adjacent ones of said parallel lines is dependent upon a second tooth thickness of said second radial teeth.

13. The method of claim 11 wherein:

with said first radial teeth in contact with said surface, a width of each one of said parallel lines is dependent upon a first distance between adjacent ones of said first radial teeth; and with said second radial teeth in contact with said surface, said width of each one of said parallel lines is dependent upon a second distance between adjacent ones of said second radial teeth.

14. The method of claim 1 wherein:

said curable material is an adhesive; and said surface is a bonded surface of a bonded component.

15. The method of claim 1 wherein:

said first working edge comprises a first edge radius having a first edge radial center;

each one of said first radial teeth further comprises a first tooth radial center that is coaxially aligned with said first edge radial center;

said second working edge comprises a second edge radius having a second edge radial center; and each one of said second radial teeth further comprises a second radial edge having a second tooth radial center that is axially offset from said second edge radial center.

16. The method of claim 8 further comprising, with said first spacers in contact with said surface, spreading an initial amount of a curable material on said surface at a constant thickness, equal to said constant distance between said surface and said working edge, independent of said non-zero angle of orientation of said trowel relative to said surface.

17. The method of claim 8 further comprising, with said second spacers in contact with said surface, spreading an initial amount of a curable material on said surface at a variable thickness, equal to said variable distance between said surface and said working edge, dependent on said non-zero angle of orientation of said trowel relative to said surface.

18. The method of claim 8 wherein:

each one of said first spacers comprises a circular cross-sectional shape bound by said first edge-face; and said first straight-line distance extending radially outward from said first working edge to any point on said first edge-face of each one of said first spacers is equal to said constant distance between said surface and said working edge.

19. The method of claim 8 wherein:

each one of said second spacers comprises a circular cross-sectional shape bound by said second edge-face; and said second straight-line distance extending radially outward from said second working edge to any point on said second edge-face of each one of said second spacers is equal to said variable distance between said surface and said working edge.

20. The method of claim 8 wherein:

each one of said first spacers is rotatably coupled to said first working edge;

each one of said second spacers is rotatably coupled to said second working edge; and moving said trowel across said surface comprises rolling said first spacers across said surface or rolling said second spacers across said surface.

21. A method for using a trowel on a surface, said method comprising:

spacing a first working edge of said trowel a constant distance from said surface with a plurality of first spacers extending from said first working edge of said trowel, said constant distance being independent of a non-zero angle of orientation of said trowel relative to said surface;

spacing a second working edge of said trowel a variable distance from said surface with a plurality of second spacers extending from said second working edge of said trowel, said variable distance being dependent on said non-zero angle of orientation of said trowel relative to said surface, wherein each one of said second spacers comprises a circular cross-sectional shape and a second radial edge, and wherein a straight-line distance extending radially outward from said second working edge to any point on said second radial edge of each one of said second spacers is equal to said variable distance between said surface and said working edge; and with said first spacers or said second spacers in contact with said surface, moving said trowel across said surface.

* * * * *